US006997685B2

(12) United States Patent
Lemmen

(10) Patent No.: US 6,997,685 B2
(45) Date of Patent: Feb. 14, 2006

(54) HYDRAULIC SYSTEM COMPRISING A MAIN PUMP AND A PRECOMPRESSION PUMP

(75) Inventor: Ralf Lemmen, Tuebingen (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 54 days.

(21) Appl. No.: 10/363,964

(22) PCT Filed: Jun. 29, 2001

(86) PCT No.: PCT/EP01/07459

§ 371 (c)(1),
(2), (4) Date: Mar. 7, 2003

(87) PCT Pub. No.: WO02/23041

PCT Pub. Date: Mar. 21, 2002

(65) Prior Publication Data

US 2003/0185687 A1 Oct. 2, 2003

(30) Foreign Application Priority Data

Sep. 13, 2000 (DE) ..... 100 45 118

(51) Int. Cl.
*F04B 23/06* (2006.01)
*F04B 41/06* (2006.01)

(52) U.S. Cl. ..... 417/216; 417/251; 417/253

(58) Field of Classification Search ..... 417/216, 417/244, 251, 252, 253, 426, 427, 428
See application file for complete search history.

(56) References Cited

U.S. PATENT DOCUMENTS

| | | | | | |
|---|---|---|---|---|---|
| 1,877,091 | A | * | 9/1932 | Vickers | 417/216 |
| 3,431,856 | A | | 3/1969 | Whitmore et al. | |
| 4,312,626 | A | * | 1/1982 | Juran | 417/244 |
| 4,711,616 | A | * | 12/1987 | Tsukahara et al. | 417/216 |
| 5,186,612 | A | * | 2/1993 | Budzich, deceased | 417/252 |
| 5,482,441 | A | * | 1/1996 | Permar | 417/216 |
| 5,863,186 | A | * | 1/1999 | Green et al. | 417/244 |

FOREIGN PATENT DOCUMENTS

| | | |
|---|---|---|
| DE | 23 57 739 | 6/1974 |
| DE | 34 01 759 A1 | 8/1985 |
| DE | 34 01 775 C2 | 8/1985 |
| DE | 44 03 618 A1 | 8/1985 |
| DE | 199 02 292 A1 | 7/2000 |
| GB | 2 150 981 A | 7/1985 |
| WO | WO 99/61796 | 12/1999 |

* cited by examiner

*Primary Examiner*—Michael Koczo, Jr.
(74) *Attorney, Agent, or Firm*—Scully, Scott, Murphy & Presser

(57) ABSTRACT

The invention relates to a hydraulic system (1) comprising a main pump (12) and a precompression pump (5), whereby the outlet (8) of the precompression pump (5) is connected by a connecting line (9) to the inlet (11) of the main pump (12). The outlet (16) of the main pump (12) can be connected by a working line (17) to a consumer (A, B). The volume flow at the inlet (11) of the main pump (12) is changeable. The aim of the invention is to achieve greater efficiency. The precompression pump (5) comprises an adjusting device (6) for adjusting the flow rate.

13 Claims, 1 Drawing Sheet

HYDRAULIC SYSTEM COMPRISING A MAIN PUMP AND A PRECOMPRESSION PUMP

Figure 1:
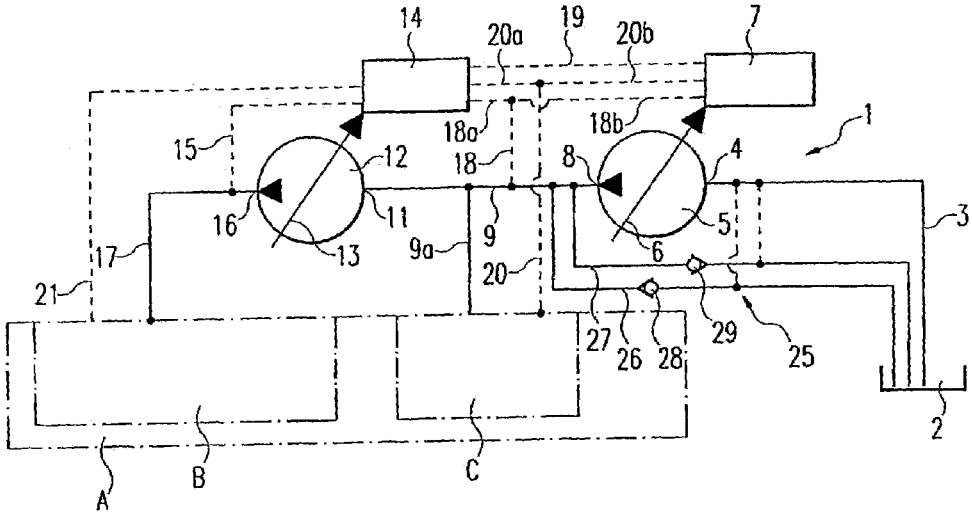

The invention relates to a hydraulic system according to the preamble of claim 1.

For various reasons it is known to associate with a hydraulic system a main pump and an admission-pressure pump, the outlet of which is connected by a connection line to the inlet of the main pump. The admission-pressure pump takes in the hydraulic medium from a tank and delivers it to the main pump. Such a hydraulic system is described e.g. in DE-A 23 57 739 and DE 34 01 775 C2. In both known systems an overflow valve or pressure relief valve disposed in or connected to the connection line ensures that a delivery quantity of the admission-pressure pump not taken over by the main pump is fed back to the tank. This is advantageous also when the delivery quantity of the main pump is greater than the delivery quantity of the admission-pressure pump in order, for example, to avoid hydraulic forcing in the starting phase and to enable an aspiration of the main pump which bypasses the admission-pressure pump.

WO 99/61796 describes a hydraulic system of the initially indicated type comprising an adjustable main pump and an admission-pressure pump, which is disposed upstream of and connected to the main pump by a connection line, wherein disposed in the connection line is an adjustable throttle, which is adjustable by means of an electronic control device. By said means the inlet pressure of the main pump may be varied, so that an influence may be brought to bear upon the delivery quantity of the main pump. The drawback of said known construction is that in operating mode heat is generated by the throttle and not only proves to be a power loss but also leads to heating of the hydraulic medium with attendant cooling problems.

The underlying object of the invention is to construct a hydraulic system of the initially indicated type in such a way that a high efficiency of the system is achievable.

Said object is achieved by the features of claim 1. Advantageous developments of the invention are described in the sub-claims.

In the hydraulic system according to the invention, the admission-pressure pump has an adjusting apparatus for adjusting the displaced volume. Said construction according to the invention is advantageous from several aspects. Firstly, it is possible to increase or optimize the intake pressure of the main pump and reduce losses resulting therefrom and hence increase the efficiency and the capacity of the main pump and the system. A flow resistance and a loss resulting therefrom, such as exists in the known system according to WO 99/61796 as a result of the adjustable throttle, no longer applies in the construction according to the invention.

Within the framework of the invention it is possible for an adjustment of the admission-pressure pump and a locking and/or positioning in the set position to be effected manually or by means of a control or regulating device. The first case merely requires a manually actuable adjusting mechanism of the admission-pressure pump. In the second case, a preferably automatically operating control or regulating device is associated with the adjusting apparatus of the admission-pressure pump.

The sub-claims contain i.a. features, which enable the utilization of various control and regulating features.

Within the framework of the invention it is also possible for the delivery quantities of the admission-pressure pump and main pump to be tuned to advantageous ratios, e.g. to be controlled or regulated in such a way that the delivery quantity ratio is always identical. By said means a constant intake pressure is achieved for the main pump and variations of the delivery quantity of the main pump, which are caused by intake pressures of differing magnitude, are avoided.

Figure 2:
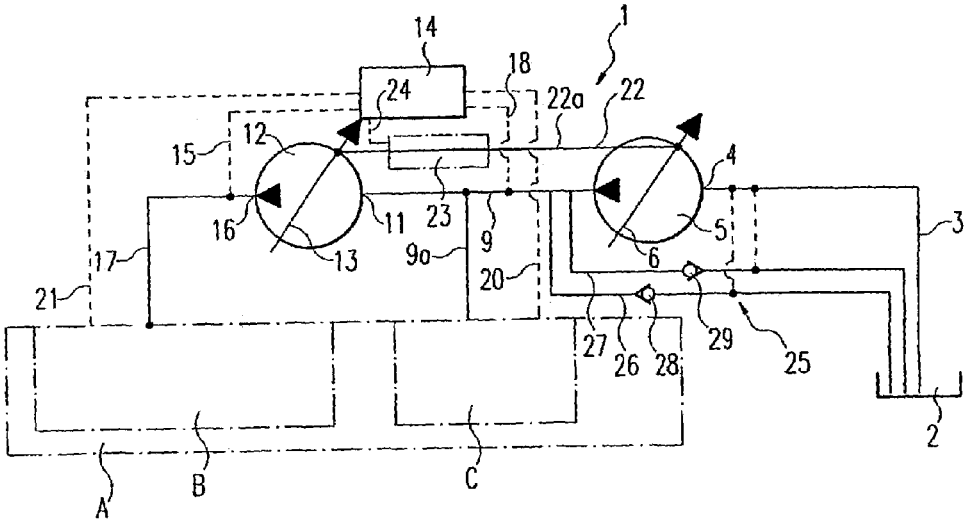

There now follows a detailed description of the invention and of further advantages achievable thereby with reference to advantageous constructions of embodiments and simplified drawings. The drawings show FIG. 1 a hydraulic system according to the invention as an operational diagram;

FIG. 2 the system in a modified construction.

In the hydraulic system denoted as a whole by 1, a suction line 3 extends from a tank 2 to the inlet 4 of an admission-pressure pump 5, the displaced volume of which is adjustable. The admission-pressure pump 5 has an adjusting apparatus 6, which is adjustable by means of a first control or regulating device 7 and lockable in the adjusted and/or set position.

A connection line 9 extends from the outlet 8 of the admission-pressure pump 5 to the inlet 11 of a main pump 12, the displaced volume of which is preferably likewise adjustable. To said end, the main pump 12 has an adjusting apparatus 13, which is adjustable and settable by means of a second control or regulating device 14.

The invention is not restricted to a particular style of construction or mode of operation of the pumps 5, 12. The same applies to the adjusting apparatuses 6, 13 and the control or regulating devices 7, 14. These may be of one of the known styles of construction and modes of operation. The pumps may be, in each case, e.g. a vane-cell pump, a radial piston pump or preferably an axial piston pump. The pumps 5, 12 may be pressure-controlled or delivery quantity-controlled or capacity-controlled. The regulating devices 7, 14 may comprise a pressure regulator or delivery quantity regulator or capacity regulator.

The previously mentioned control or regulating functions are controlled or regulated by the associated control or regulating apparatus 7, 14 while taking account of control or regulating signals, which are supplied to the control or regulating device 7, 14 by means of control and/or signal lines.

FIG. 1 shows a control and/or signal line 15, which extends from a working pressure line 17, which extends from the outlet 16 of the main pump 12 to a consumer A, to the second control or regulating device 14. Here, it may be a matter of a pressure signal for a pressure regulator or a delivery quantity signal for a delivery quantity regulator or a pressure and delivery quantity signal for a capacity regulator.

Pressure signals or delivery quantity signals of the admission-pressure pump may also be supplied to a pressure regulator or delivery quantity regulator of the first control or regulating device 7, e.g. through a control and/or signal line 18 which connects the connection line 9 to the first control or regulating device 7. It is also possible to supply said signals also or only to the pressure regulator or delivery quantity regulator or capacity regulator of the second regulating device 14, this being illustrated by a control and/or signal line branch 18*a* connected to the second regulating device 14.

Within the framework of the invention it is also possible to operate the first control or regulating device 7 in dependence upon the second control or regulating device 14. Here, corresponding signals are transmitted from the second control or regulating device 14 to the first control or regulating device 7, e.g. through a signal line 19 which connects them. In said case, it is possible to dispense with the control and/or signal line branch 18*b*.

The control or regulating signals may also be supplied from the consumer A to the first control or regulating device 7 and/or to the second control or regulating device 14, e.g. through signal lines which connect the consumer A in each case to the first and/or second control or regulating device 7, 14. It is also possible that two consumers B, C e.g. of an appliance are provided, of which the control or regulating signals of the one consumer B are supplied to the second control or regulating device 14 and the control or regulating signals of the other consumer C are supplied to the first control or regulating device 7, e.g. through the signal lines 20, 21. Here too, it is possible to supply the signals of the consumer B and/or C to the second control or regulating device 14 and/or to the first control or regulating device 7, this being illustrated by the signal line branches 20*a*, 20*b*.

The second consumer C may be connected by a connection line branch 9*a* to the connection line 9 and hence be supplied from the latter.

Within the framework of the invention it is also possible according to the embodiment of FIG. 2, in which identical or comparable parts are provided with identical reference characters, to control or regulate the admission-pressure pump 5 in dependence upon the main pump 12 by means of a mechanical coupling 22, which connects the adjusting apparatuses 6, 13 to one another. When the adjusting apparatuses 6, 13 are formed by swivel apparatuses, the coupling 22 may be formed e.g. by a connecting rod 22*a*, which is connected in an articulated manner to the swivel apparatuses and/or to their pivoted levers. Such a construction is illustrated in FIG. 2.

When the admission-pressure pump 5 is adjusted and set in dependence upon the adjustment of the main pump 12 by means of a suitable control or regulating device or coupling, both pumps 5, 12 always have the same setting and/or delivery quantity ratio, e.g. the same swivel angle. In said case, the pressure in the connection line 9 and hence the intake pressure of the main pump 12 is always constant. On the other hand, when the admission-pressure pump 5 is controlled or regulated independently of the main pump 12, the pressure in the connection line 9 and hence also the intake pressure of the main pump 12 is different depending on the adjustment position of the admission-pressure pump 5.

It is moreover also possible, given the provision of a coupling 22, to realize an adjustment which varies from a synchronous adjustment of the admission-pressure pump 5, e.g. an adjustment which varies in accordance with a specific characteristic curve. This may be effected e.g. by means of a gear 23, which is illustrated in an implied manner or a motor which is integrated into the mechanical coupling 22 and may be connected e.g. by a control and/or signal line 24 to the second control or regulating device 14. The gear 23 or motor may be integrated into the mechanical coupling 22 and/or into the connecting rod 22*a* e.g. in such a way that they increase or shorten their effective length, i.e. the distance of the connection and/or articulation points, in the desired manner.

In all embodiments it is moreover also possible to establish between the connection line 9 and the tank 2 a hydraulic compensating connection 25 or overflow connection which, when the delivery quantities of the pumps 5, 12 are not of equal magnitude, makes it possible to allow an overflow of the hydraulic medium to the tank or vice versa. When, for example, the delivery quantity of the main pump 12 is lower than the delivery quantity of the admission-pressure pump 5, hydraulic fluid may bypass the admission-pressure pump 5 and flow to the tank 2. On the other hand, it is also possible to take in hydraulic fluid towards the connection line 9, while bypassing the admission-pressure pump 5, when the delivery quantity of the main pump 12 is higher than that of the admission-pressure pump 5. To enable this, for example, two bypasses 26, 27, which are formed by hydraulic lines and bypass the admission-pressure pump 5, may be formed, which connect the connection line 9 to the tank 2 or to the suction line 3. Disposed in each of the bypasses 26, 27 is a valve 28, 29, preferably a non-return valve, of which the one valve 28 makes it possible to take in hydraulic fluid towards the connection line 9, while the other valve 29 makes it possible to allow hydraulic fluid to flow from the connection line 9 towards the tank 2 or towards the suction line 3. The bypasses 26, 27 may be connected to the tank 2 or to the suction line 3, this being illustrated by indicated line branches.

In all embodiments it is moreover also possible for the admission-pressure pump 5 to be disposed separately from the main pump 12 or mounted onto the main pump 5 or integrated into the main adjusting system, e.g. into the main pump 12.

What is claimed is:

1. Hydraulic system (1) comprising a main pump (12) and an admission-pressure pump (5), wherein the outlet (8) of the admission-pressure pump (5) is connected by a connection line (9) to the inlet (11) of the main pump (12), wherein the outlet (16) of the main pump (12) is connectable by a working line (17) to at least one consumer (A, B), wherein the volumetric flow at the inlet (11) of the main pump (12) is variable, and wherein the admission-pressure pump (5) has an adjusting apparatus (6) for adjusting its delivery quantity, characterized in that said first connection line (9) includes a connection line branch (9*a*) for connection to a further consumer (C).

2. Hydraulic system (1) comprising a main pump (12) and an admission-pressure pump (5), wherein the outlet (8) of the admission-pressure pump (5) is connected by a connection line (9) to the inlet (11) of the main pump (12), wherein the outlet (16) of the main pump (12) is connectable by a working line (17) to at least one consumer (A, B), wherein the volumetric flow at the inlet (11) of the main pump (12) is variable, wherein a compensating apparatus (25) for the hydraulic medium is selectively arranged between the connection line (9) or a connection line branch (9*a*) and a tank (2) or a suction line (3) which extends between said tank (2) and the admission-presence pump(s), said compensating apparatus (25) being formed by a bypass (26, 27) which bypasses the admission-pressure pump (5), a non-return valve being located in said bypass so as to enable a flow in the one flow direction and blocking a flow in the opposite flow direction, characterized in that the admission-pressure pump (5) has an adjusting apparatus (6) for adjusting its delivery quantity, and wherein there are provided two of said bypasses (26, 27), each having valves (28, 29) which open and block flows in said bypasses in mutually opposite flow directions.

3. Hydraulic system according to claim 1 or 2, characterized in that the main pump (12) includes a further adjusting apparatus (13) for adjusting its delivery quantity.

4. Hydraulic system according to claim 3, characterized in that the adjusting apparatus (6) of the admission-pressure pump (5) and the adjusting apparatus (13) of the main pump (12) are selectively controllable by an individual control device (14) or a common control device (14).

5. Hydraulic system according to claim 4, characterized in that the main pump (12) is controlled while taking account of the pressure in the working line (17) and selectively the pressure in the connection line (9).

6. Hydraulic system according to claim 1 or 2, characterized in that the admission-pressure pump (5) is controlled while taking account of the pressure in the working line (17) and selectively the pressure in the connection line (9).

7. Hydraulic system according to claim 3, characterized in that the main pump (12) is controlled while taking account of control signals from at least one said consumer (A, B).

8. Hydraulic system according to claim 1 or 2, characterized in that the admission-pressure pump (5) is controlled while taking account of control signals from at least one said consumer (A, B).

9. Hydraulic system according to claim 4, characterized in that a first control device (7) for said adjusting apparatus (6) or the control device or devices (14) each comprise a pressure regulator.

10. Hydraulic system according to claim 4, characterized in that a first control device (7) of the adjusting apparatus (6) or the control device or devices (14) each comprise a delivery quantity regulator.

11. Hydraulic system according to claim 4, characterized in that a first control device (7) of the adjusting apparatus (6) or the control device or devices (14) each comprise a capacity regulator.

12. Hydraulic system according to claim 4, characterized in that a control device (7) of the admission-pressure pump (5) and the control device or devices (14) of the main pump (12) selectively take into account function signals from the consumer (A) or from an associated consumer (B, C).

13. Hydraulic system according to claim 2, characterized in that a compensating apparatus (25) for the hydraulic medium is provided selectively between the connection line (9) and the connection line branch **(9*a*) and selectively between the tank (2) and the suction line (3)**.

* * * * *